US005099596A

United States Patent [19]

Butler, Jr.

[11] Patent Number: 5,099,596

[45] Date of Patent: Mar. 31, 1992

[54] QUICK RELEASE CHILD RESISTANT IMMOBILIZATION DEVICE FOR HANDGUNS

[76] Inventor: Bernard G. Butler, Jr., P.O. Box 13348, Jackson, Miss. 39236

[21] Appl. No.: 687,000

[22] Filed: Apr. 18, 1991

[51] Int. Cl.[5] ..... F41A 17/74

[52] U.S. Cl. ..... 42/70.11

[58] Field of Search ..... 42/70.11, 96

[56] References Cited

U.S. PATENT DOCUMENTS

| | | | |
|---|---|---|---|
| 4,412,397 | 11/1983 | Bayn | 42/70.11 |
| 4,569,144 | 2/1986 | Thurber | 42/70.11 |
| 4,961,277 | 10/1990 | Rosenbaum | 42/70.11 |
| 5,010,675 | 4/1991 | Selleck | 42/70.11 |

OTHER PUBLICATIONS

American Rifleman, Dry-Firing Technique, Aug. 1984, p. 69.

*Primary Examiner*—Charles T. Jordan
*Attorney, Agent, or Firm*—Brady, O'Boyle & Gates

[57] ABSTRACT

A quick release child-resistant immobilization device for handguns, wherein an elastic strap is bent to form a sling and stretched around the gun hammer to hold the hammer in the inoperative position. The free ends of the strap are connected to a pin adapted to extend into the gun barrel and a handle is connected to the pin to facilitate manually pulling the pin out of the gun barrel by further stretching the strap to remove the strap from the hammer. The hammer and/or gun slide is held in the inoperative position by the tension of the stretched resilient strap until the pin is completely removed from the gun barrel, thus eliminating accidental discharge of the gun while a part of the device is still in the gun barrel. A sleeve is attachable to the pin to accommodate the mounting of the device on a gun having a bore substantially larger in diameter than that of the pin.

18 Claims, 4 Drawing Sheets

QUICK RELEASE CHILD RESISTANT IMMOBILIZATION DEVICE FOR HANDGUNS

BACKGROUND OF THE INVENTION

Many of today's families own handguns which are kept in the home or in the family car for security purposes. It is always a concern to keep the handgun stored in an out-of-the-way place far from a child's reach. No matter how careful a parent might be, there are many instances wherein a child finds a handgun around the house or car and accidentally discharges the gun resulting in serious injury or death to the child or a playmate.

To prevent these accidents, various safety devices have been proposed for handguns, wherein a strap extends around the gun hammer to a barrel insert or cap. Such devices are disclosed in U.S. Pat. Nos. 4,412,397, dated Nov. 1, 1983; 4,569,144, dated Feb. 11, 1986; and 4,961,277, dated Oct. 9, 1990. While these devices have been satisfactory for their intended purpose, they have been characterized by certain disadvantages. For instance, to remove the safety device disclosed in U.S. Pat. No. 4,412,397, it is necessary to cut the strap, thus, rendering the device non-reusable.

In U.S. Pat. No. 4,569,144, to remove the device, it is necessary to push a spring biased insert further into the gun barrel to relieve the tension of the strap extending around the hammer, thus providing a possibility of the gun being accidentally fired before the insert has been removed completely out of the barrel.

In U.S. Pat. No. 4,961,277, the strap is connected to a block in the front of the barrel, and a releasable cap is operatively connected to the block to hold the block on the front of the barrel. This device requires a plurality of parts, and manipulation to attach the device to the gun barrel and remove it therefrom.

SUMMARY OF THE INVENTION

After considerable research and experimentation, the quick release child-resistant immobilization device of the present invention has been devised to overcome the disadvantages experienced with the prior art handgun safety devices noted above, and comprises, essentially, an elastic strap bent to form a sling and stretched around the gun hammer and having its ends connected to a pin extending into the gun barrel, whereby the stretched elastic strap biases the hammer to the inoperative position. A handle or knob is connected to the pin to facilitate manually pulling the pin out of the gun barrel to remove the strap from the hammer. To adapt the safety device to larger caliber handguns, a cylindrical sleeve is attachable to the pin to increase the diameter thereof. The pin is provided with a plurality of bevelled notches which cooperate with a bevelled lock washer assembly, to fasten the opposite ends of the strap on the pin to provide the required biasing force to hold the hammer in the inoperative device, and when required, to fasten a cylindrical sleeve on the pin to adapt the device to properly fit in the bore of a larger caliber gun.

By the construction and arrangement of the safety device of the present invention, when removing the device from a handgun it is necessary to pull the pin out of the barrel, thereby further stretching the strap and increasing the biasing force against the gun hammer, whereby the tension on the strap and concomitant biasing force against the hammer is not released until the pin is completely removed from the barrel. Thus, there can be no accidental firing of the gun during the removal of the safety device.

DESCRIPTION OF THE PREFERRED EMBODIMENT

Figure 1:
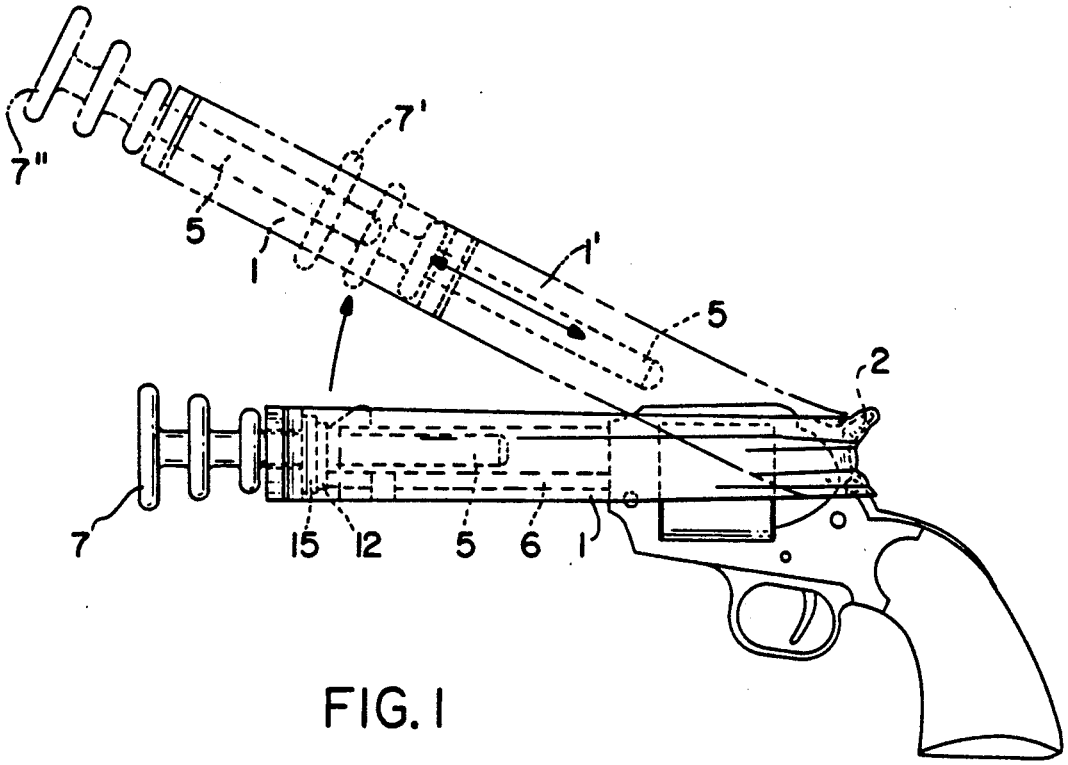
FIG. 1 is a side elevational view of the device of the present invention showing, in solid lines, the device mounted in operative position on a handgun, and, in dotted lines, the device being removed from the gun.
Figure 2:
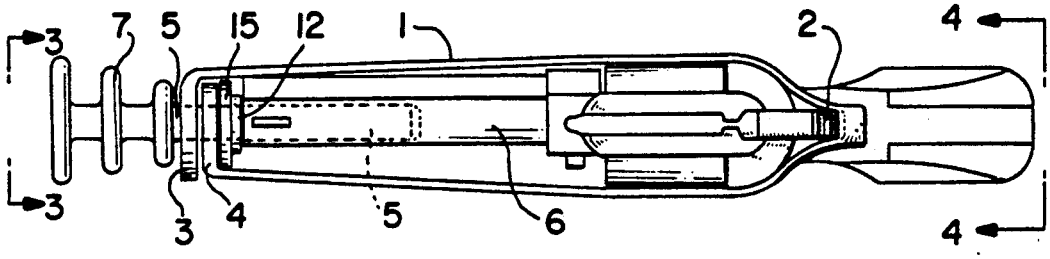
FIG. 2 is a top plan view of the device shown in FIG. 1, in the operative position.
Figure 3:
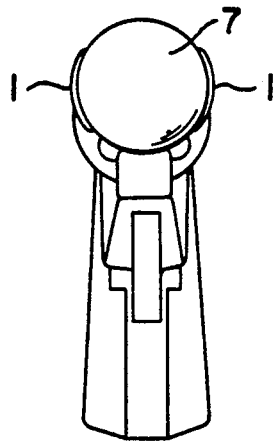
FIG. 3 is a front elevational view of the device taken along line 3—3 of FIG. 2.

Referring to the drawings and more particularly to FIGS. 1 and 2, the handgun safety device of the present invention comprises, an elastic rubber strap 1 bent to form a sling and adapted to be stretched around the hammer 2 of the gun, and having its ends 3 and 4 connected to a pin 5 extending into the bore of the gun barrel 6, whereby the stretched elastic strap 1 biases the hammer 2 to the inoperative position. A knob 7 is integral with the end of the pin 5 to form a handle facing away from the gun barrel to facilitate manually further stretching of the elastic strap, and pulling the pin 5 out of the bore of the gun barrel 6, as shown in dotted lines in FIG. 1, to quickly remove the safety device from the gun. After removal of the pin from the gun barrel 6, the elastic strap 1 returns to its relaxed state, as shown at 1' in dotted lines, as the elastic strap is removed from around the hammer.

Figure 5:
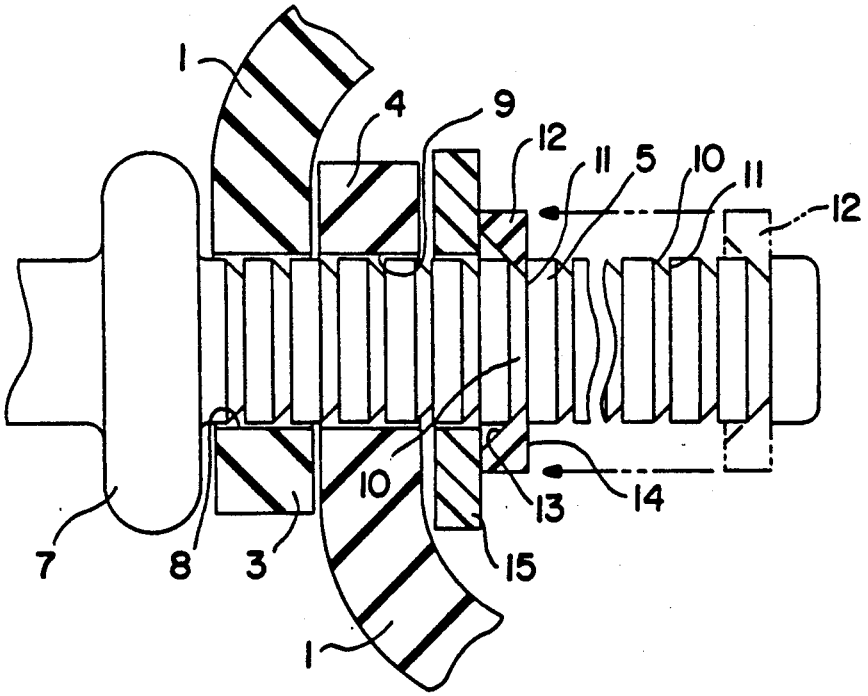
FIG. 5 is an enlarged, fragmentary, foreshortened, side elevational view, partly in section, showing the connection of the strap ends to the pin.

The pin 5 and knob 7 are preferably integrally molded of plastic material, for example, polypropylene. The details of the connection of the strap ends 3 and 4 are illustrated in FIG. 5, wherein it will be seen that the strap ends are provided with holes 8 and 9 through which the pin 5 extends. The pin is formed with a notched surface, comprising a plurality of spaced circumferential notches extending substantially the length of the pin, with each circumferential notch having an inclined surface 10 and a vertical or planar surface 11, at right angles to the longitudinal axis of pin 5, and which cooperate with a lock washer 12 having correspondingly shaped and mating inclined and planar surfaces 13 and 14, respectively. A washer 15 is interposed between one of the strap ends, such as end 4, and the lock washer 12 is moved in the direction of the arrows in FIG. 5 into abutting relationship therewith to thereby fasten the strap ends 3 and 4 to the pin 5. Lock washer 12 is constructed of yieldable plastic material with its bore smaller than the diameter of pin 5 but slightly larger in diameter than the diameter of the pin at the base of the circumferential notches, at the junction of the inclined and planar surfaces 10 and 11. The lock washer 12 can thus move along pin 5 only in one direction, that is toward knob 7, with the inclined surface 13 on the lock washer 12 that surrounds its aperture, camming the same over the circumferential notches as it is slid over and up the pin 5 from the base toward the knob 7.

Figure 4:
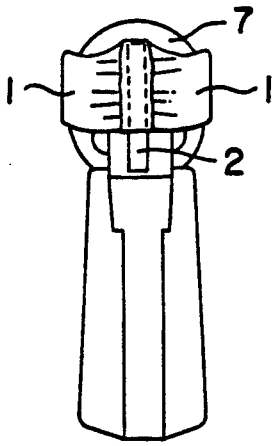
FIG. 4 is a rear elevational view of the device taken along line 4—4 of FIG. 2.
Figure 6:
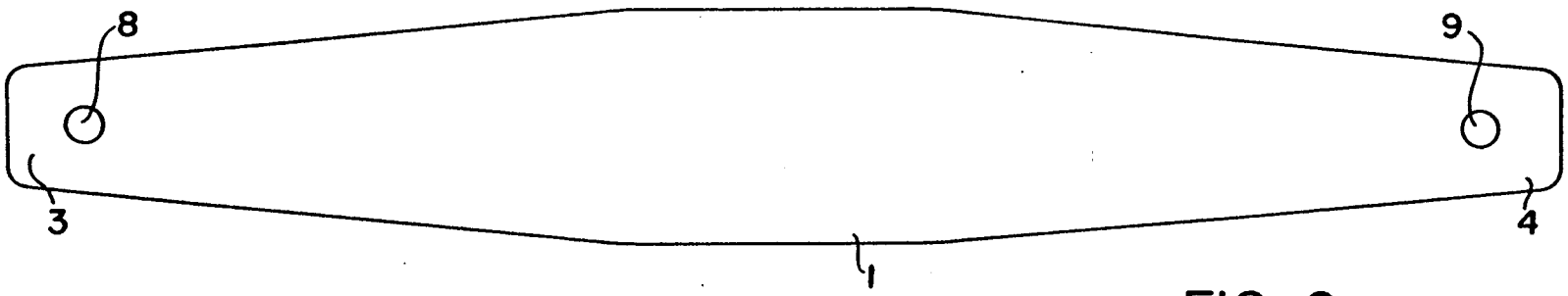
FIG. 6 is a plan view of the elastic strap employed in the device of the present invention.

As will be seen in FIG. 6, the strap 1 is wider in the middle than at each end portion. This middle portion extends around and substantially encloses the hammer 2 as shown in FIGS. 1, 2, and 4.

Figure 7:
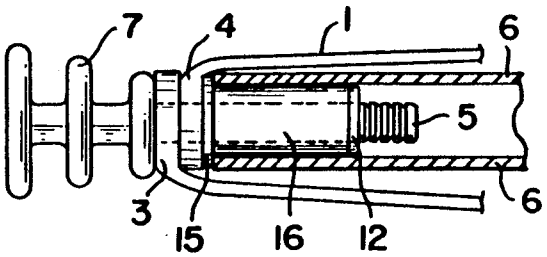
FIG. 7 is a fragmentary, side elevational view, partly in section, showing a sleeve mounted on the pin and inserted into a gun barrel.
Figure 8:
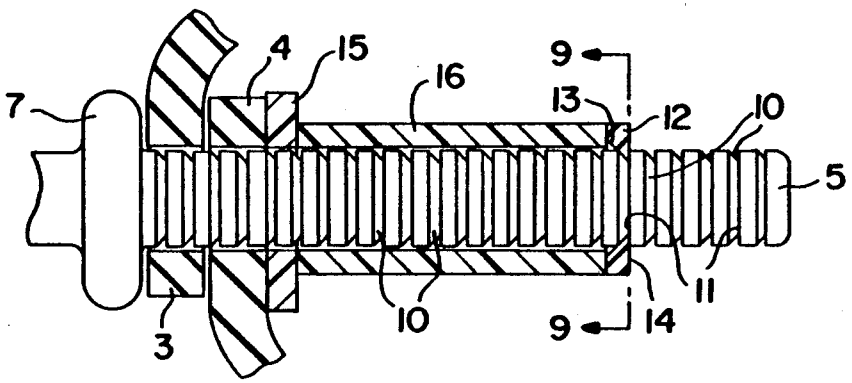
FIG. 8 is an enlarged, fragmentary view, partly in section, showing the pin and sleeve assembly illustrated in FIG. 7.
Figure 9:
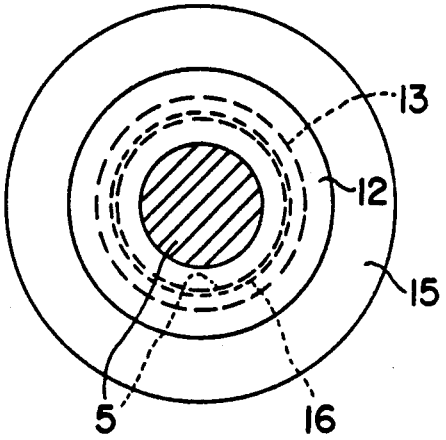
FIG. 9 is a cross-sectional view taken along line 9—9 of FIG. 8.

Pin 5 preferably has a length from its end to the knob 7 of approximately two inches, and a diameter of 0.220 inches so as to fit into the barrels of handguns of 22, 25, and 32 caliber. To facilitate the attachment of the device to a gun wherein the bore of the barrel is substantially larger than the diameter of the pin 5, as will be seen in FIGS. 7 and 8, a cylindrical sleeve 16 is slidably mounted on the pin 5 and is held in abutting relationship against the washer 15 by the lock washer 12. Cylindrical sleeves of several diameters may be provided so the device can fit handguns of all calibers. One sleeve 16, for instance, may have an outside diameter of approximately 0.344 inches to fit 9 mm and 357 caliber handguns; and another sleeve 16 may have an outside diameter of approximately 0.420 inches to fit 44 and 45 caliber handguns. Washer 15 is larger in diameter than the bore of the gun barrel to thus abut against the front of the gun barrel in the use position when a sleeve 16 is utilized. Lock washer 12 is smaller in diameter than washer 15, but is larger in diameter than the bore of the smaller caliber gun barrel into which the pin 5 is inserted. When the safety device is used without a sleeve 16, the lock washer 12 abuts against the front of the gun barrel, as shown in FIGS. 1 and 2, but when used with a sleeve, its diameter is such that it fits inside the bore, as shown in FIG. 7.

Figure 10:
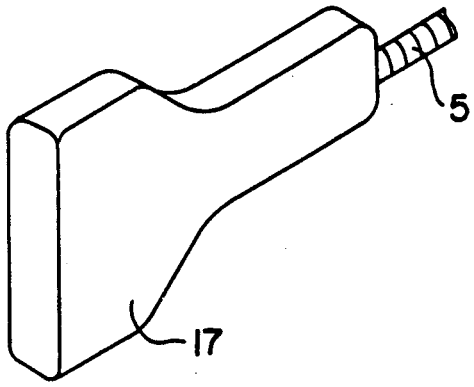
FIG. 10 is a perspective view of a modified form of the handle connected to the end of the pin.

The device shown in the FIGS. 1, 2, 5, 7, and 8 employs a knob shaped handle 7, preferably formed of three spaced circular discs, graduated in diameter from the largest disc on the end of the knob toward the smallest diameter disc which forms a stop surface for the strap ends 3 and 4. This shape knob can be gripped from any direction, and it has been found that the spacing and graduation of the discs in diameter greatly diminishes the possibility of the hand slipping off the knob when quickly grabbed and pulled outwardly. However, other shapes of knobs can be used. FIG. 10 discloses another modified handle 17 having a substantially T-shaped configuration adapted to be gripped by the hand or between the finger to pull it outwardly.

Figure 11:
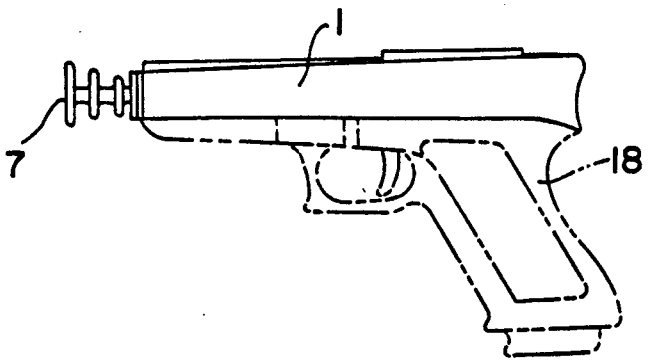
FIG. 11 is a side elevational view of the device connected to a large caliber semi-automatic handgun.
Figure 12:
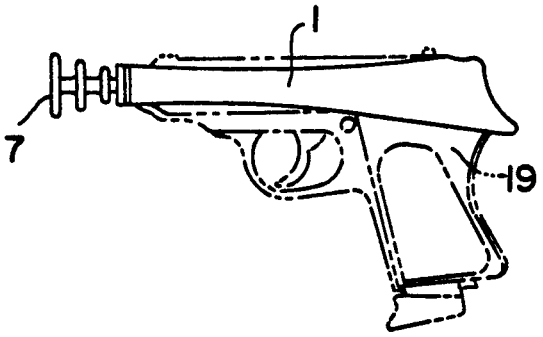
FIG. 12 is a side elevational view of the device connected to a small caliber semi-automatic handgun.

FIG. 11 illustrates the mounting of the device on a relatively large caliber handgun 18, such as a semi-automatic 45 caliber handgun. FIG. 12 illustrates the mounting of the device on a smaller semi-automatic handgun 19, such as a 9 mm handgun. In each instance, the rubber strap 1 extends around the back of the top slide on the gun as well as around the hammer, thus biasing both the slide and the hammer 2 forward to the inoperative position, and preventing either the slide or the hammer from moving rearward to cock or fire the gun.

In use, the rubber strap 1 is bent to form a sling and the ends 3 and 4 are connected to the pin 5, as shown in FIGS. 1, 2, and 5. The bight portion of the strap 1 is placed around the gun hammer 2, as shown in FIG. 1, or around the gun hammer and slide, as shown in FIGS. 11 and 12, and the user then pulls the handle 7, from the position shown at 7 in FIG. 1 to the position shown at 7'', to stretch the strap 1 to extend the free end of the pin 5 beyond the open end of the gun barrel 6. The pin 5 is aligned with the base of the barrel 6 and the handle 7 is released resulting in the contraction of the strap 1 forcing the pin 5 to slide into the gun barrel 6, whereby the stretched elastic strap 1 biases the hammer 2 forward to the inoperative position.

To remove the device from the gun, the user pulls the handle 7 forwardly away from the gun barrel 6, to stretch the strap 1 further to remove the pin 5 outwardly of the gun barrel 6 to a position 7'' out of alignment with the gun barrel, as shown in phantom in FIG. 1. The handle 7 is then released allowing the strap to contract to the unstretched position 1', 7' so that the strap can be removed from the hammer 2.

From the above description it will be appreciated by those skilled in the art that the construction and arrangement of the device of the present invention immobilizes a gun to such a degree that most children do not have the strength and coordination necessary to take the strap 1 off the gun, thereby rendering the device child-resistant. However, an adult can quickly and easily remove the device from a gun.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A child-resistant immobilization device for a handgun having a hammer and a gun barrel with an open end comprising, an elastic strap bent to form a sling having a bight portion adapted to be stretched from a relaxed state to a stretched elongated state extending around a gun to hold the hammer in an inoperative position, the strap having a pair of free ends adapted to be positioned near the open end of the gun barrel in the stretched state of said strap, and means for connecting said free ends of said strap together and adapted to connect said free ends to the open end of the gun barrel.

2. The device according to claim 1, wherein the means for connecting the free ends of the strap together and to the open end of the gun barrel, comprises a hole provided in each end portion of the strap, the end portions of the strap being overlapped to thereby position the holes in alignment, a pin extending through the aligned holes, and fastening means securing the free ends of the strap to the pin.

3. The device according to claim 2, wherein the fastening means comprises a notched surface provided on the pin surface, a cooperating lock washer assembly slidably mounted on the notched surface, and a handle secured to one end portion of the pin, the overlapped end portions of said strap being gripped between the handle and said lock washer assembly.

4. The device according to claim 3, wherein said pin having a free end portion which extends into the open end of a gun barrel, whereby the device can be removed from the gun by pulling on the handle to stretch the strap to thereby pull the pin outwardly of the gun barrel, while maintaining the biasing force of the sling bight portion against the hammer, whereby the hammer is held in the inoperative position while removing the device.

5. The device according to claim 3, in which said pin has a diameter, wherein said lock washer assembly includes a sleeve mounted on the pin coaxially therewith, and means for securing the sleeve on said pin, to thereby accommodate the device for mounting on a handgun having a bore substantially larger than the diameter of the pin.

6. The device according to claim 5, wherein the means for securing the sleeve to the pin comprises a washer interposed between one end portion of the strap and one end of the sleeve, said sleeve having an opposite end portion, and a lock washer mounted on said pin butting the opposite end portion of the sleeve.

7. The device according to claim 2, including a handle on one end of said pin, said pin having a free end adapted to extend into the bore of a gun barrel, the overlapped end portions of said strap being gripped on said pin between said handle and said fastening means.

8. The device according to claim 7, in which said fastening means includes a lock washer assembly connected to said pin.

9. The device according to claim 7, in which said pin has a circumferential surface, said fastening means includes a plurality of spaced circumferential locking notches along said circumferential surface, and a lock washer slidably on said pin and mating with said locking notches.

10. The device according to claim 9, including a washer on said pin interposed between said lock washer and said end portions of said strap.

11. The device according to claim 9, in which said fastening means includes a sleeve mounted on said pin coaxially therewith.

12. The device according to claim 11, including a washer connected on said pin coaxially therewith between said sleeve and said end portions of said strap.

13. The device according to claim 7, including a washer connected on said pin coaxially therewith between said fastening means and said end portions of said strap, and said washer being larger in diameter than the bore of a gun barrel to which the device is adapted to be connected.

14. The device according to claim 9, in which said pin has a longitudinal axis, said circumferential locking notches each include an inclined surface and a planar surface coaxial with said longitudinal axis.

15. The device according to claim 13, in which said lock washer includes a corresponding inclined surface and planar surface that cooperates with the inclined surface and planar surface of the circumferential locking notches.

16. The device according to claim 14, in which said planar surface is perpendicular to the longitudinal axis of said pin, and said lock washers having a planar surface adapted to mate with the planar surfaces of said locking notches.

17. A child-resistant immobilization device for a handgun having a hammer and a gun barrel with an open end comprising, an elastic strap bent to form a sling having a bight portion at one end adapted to be stretched from a relaxed state to a stretched elongated state extending around a gun to hold the hammer in an inoperative position, the strap having an end opposite the bight portion adapted to be positioned near the open end of the gun barrel in the stretched state of said strap, and means connected to said opposite end of said strap and adapted to connect said opposite end to the open end of the gun barrel.

18. The device according to claim 17, wherein the means connected to said opposite end of said strap and adapted to connect said opposite end to the open end of the gun barrel, comprises aperture means provided in said opposite end of the strap, a pin extending through said aperture means, and fastening means securing the said opposite end of the strap to the pin.

* * * * *